US007980908B2

(12) United States Patent
Niessner et al.

(10) Patent No.: US 7,980,908 B2
(45) Date of Patent: Jul. 19, 2011

(54) SPARK PLUG AND METHOD FOR PRODUCTION OF A SPARK PLUG

(76) Inventors: Werner Niessner, Steinheim (DE); Lutz Frassek, Rödental (DE); Hans Houben, Würselen (DE)

( * ) Notice: Subject to any disclaimer, the term of this patent is extended or adjusted under 35 U.S.C. 154(b) by 243 days.

(21) Appl. No.: 12/138,343

(22) Filed: Jun. 12, 2008

(65) Prior Publication Data

US 2008/0309214 A1 Dec. 18, 2008

(30) Foreign Application Priority Data

Jun. 14, 2007 (DE) ..... 10 2007 027 319

(51) Int. Cl.
*H01T 21/02* (2006.01)

(52) U.S. Cl. ..... 445/7; 313/143; 313/118

(58) Field of Classification Search ..... 313/118–145; 123/169 R, 169 EL, 32, 41, 310
See application file for complete search history.

(56) References Cited

U.S. PATENT DOCUMENTS

| | | | | |
|---|---|---|---|---|
| 4,400,643 | A * | 8/1983 | Nishio et al. | 313/11.5 |
| 4,427,915 | A | 1/1984 | Nishio et al. | |
| 4,489,596 | A * | 12/1984 | Linder et al. | 73/114.19 |
| 4,519,784 | A | 5/1985 | Pollner | |
| 4,713,582 | A * | 12/1987 | Yamada et al. | 315/58 |
| 5,204,579 | A * | 4/1993 | Oshima et al. | 313/143 |
| 6,407,487 | B1 | 6/2002 | Sugimoto | |
| 7,160,584 | B2 * | 1/2007 | Goeb et al. | 427/454 |
| 7,298,070 | B2 | 11/2007 | Kanao | |
| 2002/0079801 | A1 * | 6/2002 | Klett et al. | 313/143 |
| 2006/0076865 | A1 * | 4/2006 | Shibata et al. | 313/143 |
| 2007/0046162 | A1 * | 3/2007 | Moribe et al. | 313/143 |
| 2007/0228915 | A1 * | 10/2007 | Honda et al. | 313/143 |
| 2008/0036241 | A1 | 2/2008 | Aisenbrey | |

FOREIGN PATENT DOCUMENTS

| | | |
|---|---|---|
| GB | 717 555 | 10/1954 |

* cited by examiner

*Primary Examiner* — Nimeshkumar D Patel
*Assistant Examiner* — Donald L Raleigh

(57) ABSTRACT

The invention describes a spark plug having an outer electrode (12), a central electrode (10), an inner conductor (2) connected to the central electrode (10) and an insulator (3) enclosing the inner conductor (2). It is provided according to the invention that the insulator (3) is produced by extrusion. The invention further relates to a method for production of a spark plug of that kind.

4 Claims, 2 Drawing Sheets

SPARK PLUG AND METHOD FOR PRODUCTION OF A SPARK PLUG

The present invention relates to a spark plug for use in combustion engines, having an outer electrode, a central electrode, an inner conductor connected to the central electrode and an insulator body enclosing the inner conductor, and to a method for production of a spark plug of that kind.

In operation spark plugs are subjected to pressure and temperature conditions that place exacting demands on the mechanical strength of the insulator body and the sealing of the boundary surfaces between different plug elements, relative to the combustion chamber of an engine. Under the effect of high peak pressures it may happen, even with plugs that have been produced accurately to size and have been carefully sealed, that gases leak out from the combustion chamber via inadequately sealed areas of the spark plug. Such leakage gases, which may enter the interior of the plug along boundary surfaces between the central electrode and the insulator body, or the inner conductor and the enclosing insulator body, may produce deposits in the interior of the spark plug which increase the risks of shunts forming, thereby limiting the service life of a spark plug.

The demands placed on spark plugs are even aggravated by the trend to further miniaturization which is accompanied by exacting demands on the loading capacity, for example in racing applications.

SUMMARY OF THE INVENTION

Now, it is the object of the invention to show how the high demands placed on spark plugs can be met more efficiently.

The invention achieves this object by a spark plug of the before-mentioned kind by the use of an extruded insulator body. It has been found that insulator bodies for spark plugs providing improved material properties and, thus, an improved loading capacity can be produced by extrusion. The improved material properties allow a higher degree of miniaturization so that it is now possible to produce spark plugs according to the invention having smaller external thread sizes, especially thread size M12, M10 or even M8. This is an important advantage for example for racing engines and similar applications where the space taken by spark plugs should be as small as possible in spite of the fact that maximum speeds are desired.

The advantages provided by the production by extrusion can be utilized with even greater benefit if the inner conductor and the insulator body are produced jointly by co-extrusion, which is preferred. By co-extruding the inner conductor and the insulator body it is possible to save the expense of integrating a separately produced inner conductor into the insulator body. Further, co-extrusion permits leakage points between the inner conductor and the enclosing insulator body to be avoided practically completely so that the risk of combustion gases penetrating from the combustion chamber of an engine can be efficiently eliminated. Further, co-extruding the insulator body and the inner conductor provides the additional advantage that higher mechanical strength is achieved.

Preferably, an electrically conductive ceramic material is used for the inner conductor of a spark plug according to the invention. While previously used inner conductors made from glass, forming a suppression resistor due to embedded carbon particles, for example, can be sealed off from the surrounding insulator body only with high input and have to be integrated into the insulator body by an expensive production step, an inner conductor consisting of an electrically conductive ceramic material can be produced by co-extrusion together with the insulator body. Especially, it is possible, by suitable selection of the composition of the ceramic material used for the inner conductor, to adapt the suppression resistance of the latter to the requirements of a concrete product line, in a simple way and with narrow tolerances. This is a further advantage of spark plugs according to the invention.

For purposes of the extrusion or co-extrusion process, plasticizers such as water, paraffin or polymers may be added to the ceramic materials used for the insulator body and the inner conductor, respectively, so as to give those ceramic materials a plasticity and pasty consistence suited for the extrusion process. By extruding, preferably by co-extruding, the ceramic materials one first produces a green compact, preferably of a cylindrical shape. Due to the plasticity of the extruded materials, the green compact can be shaped, for example cut to the desired length, and provided with an annular collar on its outer contour as is typical for an insulator body of a spark plug. Aqueous/thermal debinding and firing can then be applied to expel any plasticizers remaining in the green compact and to sinter the originally plastic ceramic materials, for forming the inner conductor of a spark plug and the insulator body enclosing it.

The materials that can be used for the inner conductor include silicides, carbides, nitrides and/or borides, for example. The metal component of the silicides, carbides and/or borides, from which the ceramic material of the inner conductor may be made, may comprise molybdenum, tungsten, titanium and/or lanthanum, for example. Especially well suited as insulator body material, for co-extrusion with such an inner conductor ceramic material, is a non-oxide ceramic material based on carbides, nitrides and/or borides of the metals Si, Al and/or Ti. Especially advantageous for use as a material for the inner conductor is the combination of an $Si_3N_4$ ceramic material for the insulator body and $MoSi_2$ as material for the inner conductor, for example.

Another possibility consists in producing the insulator body predominantly or even completely from $Al_2O_3$, and in using a composite material of $Al_2O_3$ with $LaCrO_3$ and/or TiN as ceramic material for the inner conductor.

BRIEF DESCRIPTION OF THE DRAWINGS

Further features and advantages of the invention will be explained hereafter by reference to one embodiment of the invention and the attached drawings. The features described in that context may be made the subject-matter of claims either individually or in any combination.

DETAILED DESCRIPTION

Figure 1:
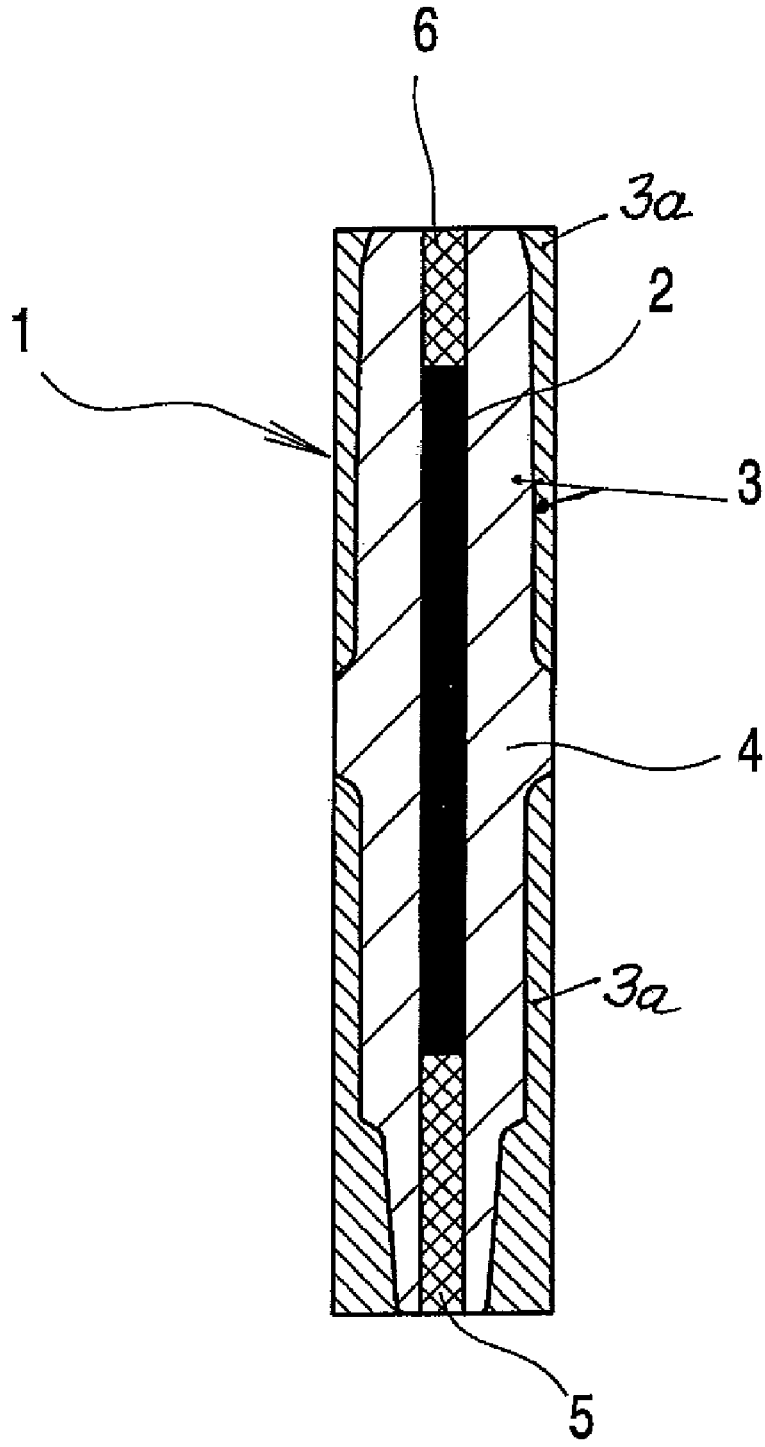
FIG. 1 shows an inner conductor with co-extruded insulator body as a semi-finished product for production of a spark plug.

FIG. 1 shows a co-extruded green compact 1 of cylindrical shape, comprising an electrically conductive ceramic material 2 intended to form an inner conductor at its center, and an electrically insulating ceramic material 3 enclosing the inner conductor 2. The co-extruded green compact 1 constitutes a semi-finished product for the production of a spark plug. The green compact 1 is given the length desired for a spark plug, and its outer contour is shaped so that the electrically insulating ceramic material 3 assumes the contour with a collar 4 usual for a spark plug. The outer areas 3*a* of the green compact 1 that are to be removed by shaping operations, for example by lathe cutting or grinding, are shown as hatched areas in FIG. 1. Due to the plasticity required for the co-extrusion process, the green compact 1 can be worked relatively easily. A hard, mechanically strong ceramic body comprising a crystalline inner conductor 2 and an insulator 3 enclosing the inner conductor are obtained only when the green compact 1 is subjected to firing. In principle, the ceramic body may be shaped or reworked also after the firing process.

In the case of the embodiment illustrated in FIG. 1, the electrically insulating ceramic material 3 consists predominantly, i.e. by at least 50% by weight, of $Si_3N_4$, especially by more than 90% by weight, preferably at least 95% by weight, of $Si_3N_4$. Using pure $Si_3N_4$ is of course also possible. However, it has been found that the ceramic material properties can be improved by adding other ceramic materials, especially carbides, borides and/or other nitrides.

In the illustrated embodiment, the electrically conductive ceramic material of the inner conductor consists predominantly of $MoSi_2$. Preferably, the inner conductor consists by more than 90% by weight of $MoSi_2$. While pure $MoSi_2$ may of course also be used, the material properties of the inner conductor can be improved, and/or costs can be saved, by additions of other ceramic materials.

The material used for the insulator body may for example be a ceramic material based on $Al_2O_3$. In such a case, it is an advantage for the co-extrusion process if an oxide ceramic material, especially one likewise based on $Al_2O_3$, is used for the inner conductor as well. Well suited for that purpose are composite materials based on $Al_2O_3$TiN and/or $Al_2O_3$—$LaCrO_3$.

The forward end of the green compact 1 illustrated in FIG. 1 is then worked by a further step, preferably carried out before the firing operation, to bore open the inner conductor 2. The bore 5 produced in that way is illustrated as a cross-hatched area in FIG. 1. That bore 5 is used later, preferably after the firing operation, to insert the central electrode 10 shown in FIG. 2 and to connect the latter to the inner conductor 2. Soldering is especially well suited for connecting the inner conductor 2 to the central electrode 10.

Correspondingly, the inner conductor 2 is bored open at its rear end. The bore 6 produced in this way is likewise shown as a cross-hatched area in FIG. 1. An igniter 11, shown in FIG. 2, is fitted in the bore 6 and connected to the inner conductor 2, for example by soldering.

Figure 2:
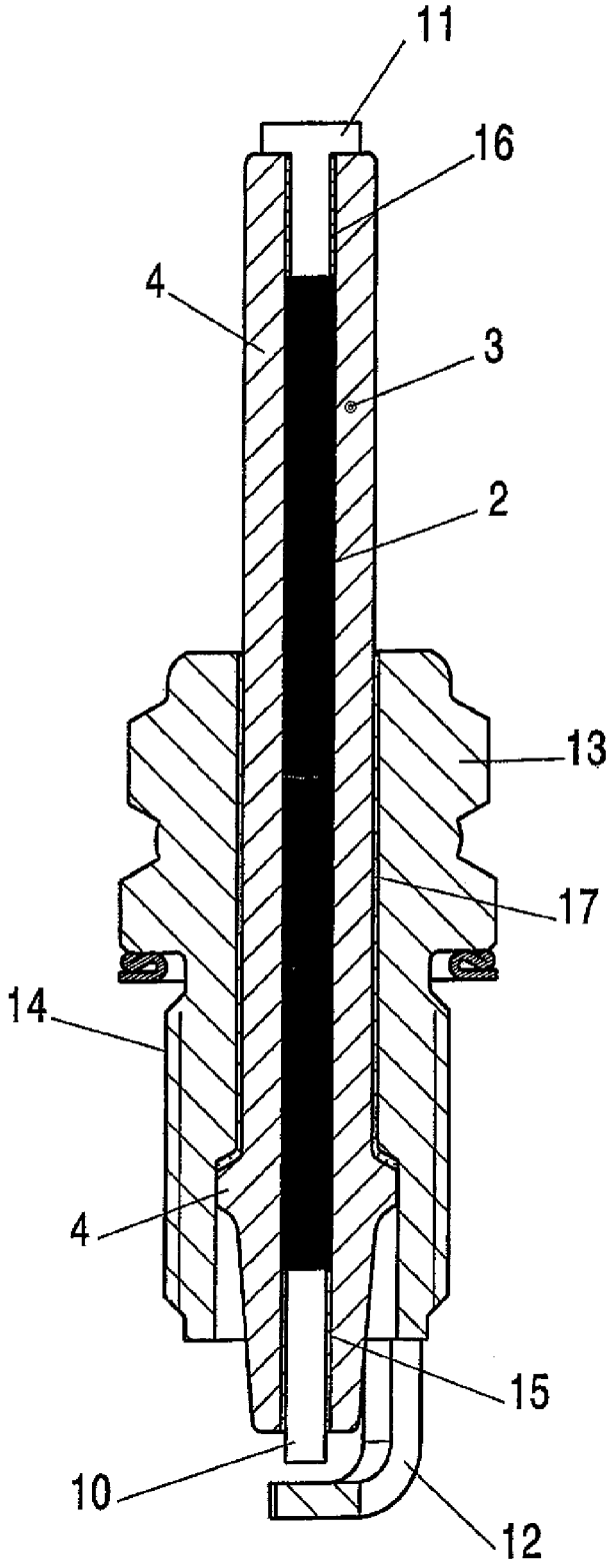
FIG. 2 shows an embodiment of a spark plug according to the invention that has been produced using the semi-finished product illustrated in FIG. 1.

FIG. 2 shows an embodiment of a spark plug produced using the semi-finished product illustrated in FIG. 1. The spark plug has at least one outer electrode 12, a central electrode 10 linked with the outer electrode 12 for producing an ignition spark, an inner conductor 2 connected to the central electrode 10 and an insulator 3 enclosing the inner conductor 2. The insulator 3 comprises a collar 4 extending around a metallic spark plug body 13. The spark plug body 13 carries an external thread 14 intended to be screwed into a matching engine opening. The good mechanical properties of the spark plug shown allow a small and compact overall size to be achieved so that even relatively small thread sizes, for example sizes below M12, can be selected for the external thread.

The central electrode 10 is connected to the enclosing insulator 3 by a solder joint 15. This allows excellent sealing to be achieved between the central electrode 10 and the insulator 3, which in turn hinders any gases from penetrating into the combustion chamber of an engine along the central electrode 10 and the inner conductor 2. The illustrated spark plug is connected to a supply line that supplies the ignition voltage via an igniter 11 which projects into the bore 6 and which contacts the inner conductor 2, as can be seen in FIG. 1. The igniter 11 is connected to the ceramic body 13 by a solder joint 16.

In order to further prevent any combustion gases from escaping from the engine space, the insulator 3 illustrated in FIG. 2 is connected in gas-tight relation with the enclosing metallic spark plug body 13 via a solder joint 17. That feature, which improves the sealing effect, is of independent importance and may especially be used also in spark plugs that comprise a conventional non-ceramic inner conductor.

Besides, improved sealing between the insulator 3 and the enclosing spark plug body 13 may be achieved also by heat-shrinking. The insulator 3 is fitted in this case in a heated spark plug body 13. As the spark plug body 13 cools down, it comes to adapt itself to the insulator 3 in gas-tight manner.

Improved sealing between the insulator 3 and the enclosing spark plug body 13 can be achieved also in a spark plug of conventional structure by the use of an inner gasket which is pre-stressed to provide a gas-tight seal by heat-shrinking the body in longitudinal direction.

LIST OF REFERENCE NUMERALS

1. Green compact
2. Inner conductor/ceramic material
3. Insulator/ceramic material
4. Collar
5. Bore
6. Bore
7. —
8. —
9. —
10. Central electrode
11. Igniter
12. External electrode/mass electrode
13. Spark plug body
14. External thread
15. Solder joint
16. Solder joint
17. Solder joint

What is claimed is:

1. Method for production of a spark plug having an outer electrode, a central electrode, an inner conductor connected to the central electrode and an insulator enclosing the inner conductor, wherein the insulator and inner conductor are produced by co-extrusion and wherein a green compact is produced by co-extrusion, having a first outer material to form the insulator and a further inner material to form the inner conductor, and that the green compact is fired subsequently.

2. The method as defined in claim 1, wherein the green compact is subjected to a shaping operation prior to being fired for forming a collar of the insulator.

3. The method as defined in claim 1, wherein the central electrode is connected with the inner conductor by soldering.

4. The method as defined in claim 1, wherein the insulator is connected with the enclosing spark plug body in gas-tight relation by heat-shrinking.

* * * * *